United States Patent [19]

Haulter

[11] 3,940,040

[45] Feb. 24, 1976

[54] CARRYING DEVICE FOR A DOLL AND A CRADLE

[76] Inventor: Earl M. Haulter, 200 N. Penn St., Shippensberg, Pa. 17251

[22] Filed: July 3, 1974

[21] Appl. No.: 485,708

[52] U.S. Cl. ..... 224/5 R; 224/25 R; 5/101

[51] Int. Cl.[2] ..... A45C 11/00

[58] Field of Search ..... 224/5 Q, 5 MA, 5 MC, 5 R, 224/5 A, 5 B, 25 R; 272/1 D; 46/116; 5/95, 101, 93 B; 211/88; 248/DIG. 3; D34/2, 15

[56] References Cited

UNITED STATES PATENTS

| | | | |
|---|---|---|---|
| 909,217 | 1/1909 | Presba | 224/5 A UX |
| 1,474,728 | 11/1923 | Nelson | 224/5 MA |
| 2,557,556 | 6/1951 | Morris | 224/5 Q |
| 3,089,597 | 5/1963 | Kaplan | 211/88 |
| 3,289,991 | 12/1966 | Kalahar | 248/DIG. 3 |

FOREIGN PATENTS OR APPLICATIONS

| | | | |
|---|---|---|---|
| 22,623 | 10/1903 | United Kingdom | 5/95 |

*Primary Examiner*—Robert J. Spar
*Assistant Examiner*—Jerold M. Forsberg

[57] ABSTRACT

A device for carrying an infant or a child's toy doll, comprising a pair of generally hook-shaped members of self supporting material, a pair of generally arcuate supporting elements detachably and adjustable disposed at respective ones of said hookshaped members, and a receptacle member removably disposed at said supporting elements and separately useable as a cradle.

4 Claims, 3 Drawing Figures

FIG. 1
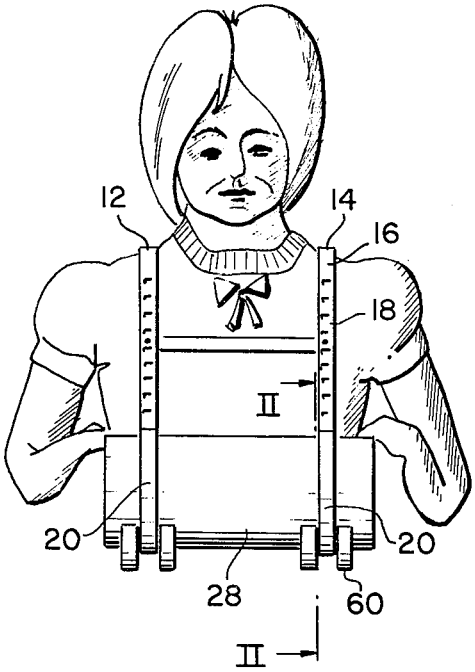
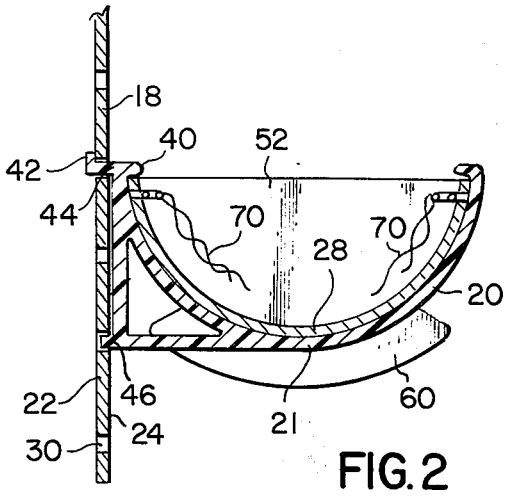
FIG. 2
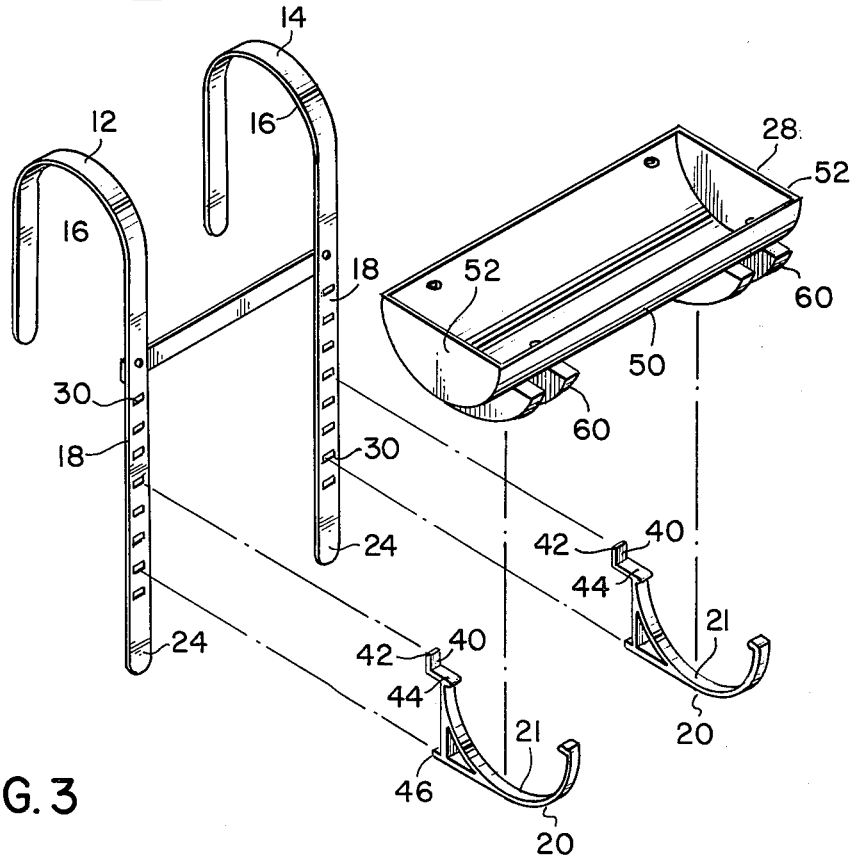
FIG. 3

CARRYING DEVICE FOR A DOLL AND A CRADLE

BACKGROUND OF THE INVENTION

The present invention relates to a carrying device, particularly to one for carrying an infant or toy doll.

Prior art devices for carrying infants generally include a basket suspended by straps from the bearers shoulders, but, because the straps are not self-supporting, this can lead to excessive bouncing of the infant while the bearer is walking. The present invention overcomes this problem and provides other advantages as well, including the ability to use a part of the carrying device separately as a cradle in a preferred embodiment.

BRIEF DESCRIPTION OF THE DRAWINGS

FIG. 1 depicts the carrying device of the present invention in use.

FIG. 2 is a sectional elevation view along axis II—II of the device in FIG. 1.

FIG. 3 is an exploded isometric view of the device in FIG. 1.

PREFERRED EMBODIMENT

Referring to FIGS. 1 through 3, the carrying device 10 comprises a pair of oppositely disposed generally hook-shaped carrying elements 12, 14 that are made of a self-supporting material (e.g., a metal, plastic, or other suitable material) and that individually comprise a curvilinear first portion 16 that is adapted to rest on or engage the user's upper torso, e.g., the shoulders, and an elongated second portion 18 that depends from the first portion 16 (corresponding parts in the drawings are given similar numeric labels). The device 10 further comprises substantially rigid supporting elements 20 that are individually disposed at the second portions 18, which can include, individually, a first major surface part 22 that faces the first portion 16 and an oppositely disposed second major surface part 24, the supporting elements 20 preferably being located at the second surface parts 24 of the respective carrying elements 12, 14 and projecting from the second surface parts 24 of their associated carrying elements in a direction opposite to the first portion. Additionally, the device 10 comprises a receptacle member 28 that is removably disposed at and supported by the supporting elements.

The second portions 18 comprise means for retaining the supporting elements 20 in place thereon, a preferred such means comprising one or more apertures 30 in each second portion 18 wherein an angular element 40 of the supporting element 20 can be inserted. It is preferred that each supporting element 20 comprise a plurality of apertures 30 along at least a portion of the length thereof to permit the position of the receptacle member 28 to be changed.

The device 10 preferably includes at least one spacing element (e.g., a stiff brace structure or a flexible band of plastic or other material) that is connected at its end portions to the respective structural or carrying elements 12, 14, preferably at the second portions 18 thereof, which spacing element limits the movements of the carrying elements 12, 14 away from each other.

The curvilinear first portions 16 can be generally C-shaped while the supporting elements or members 20 can have a part 21 generally arcuate profile, e.g., substantially C-shaped at least at the part thereof that receives and engages the receptacle member 28.

The supporting element 20 can comprise the angular element or projection 40 that comprises a first part 42 that is parallel to and adjacent the first surface 22 when the supporting element 20 is placed on the carrying element 12 or 14, and a second part 44 that is substantially perpendicular to the first part 42 and is disposed at an aperture 30 when the supporting element is in place. The supporting element 20 preferably comprises, further, a straight projection 46 that is spaced from the angular projection 40 by a predetermined distance so as to permit each to be inserted in different apertures 30.

The receptacle member 28 can be, e.g., substantially semi-cylindrical or a more shallow trough, cross-sectional configurations other than semi-circular being satisfactory. The receptacle member 28 comprises a main portion 50 and end walls 52, the external profile of the receptacle member 28 preferably conforming generally with the interior shape of the part 21 of the supporting elements 20 so as to be engaged thereby. The receptacle member 28 can be removably mounted on the supporting elements 20, to permit the infant or toy doll in the receptacle member 28 to be carried about while leaving free the bearer's hands.

According to a preferred embodiment, the receptacle member 28 further comprises at least a pair of rocker elements 60 that are spaced apart, to permit the receptacle member 28 to be used separately as a rocking cradle. It is preferred that the receptacle member 28 include two spaced pairs of rocker elements 60 (as shown in FIGS. 1 to 3), each pair of rocker elements 60 straddling a supporting element 20 to restrict the lateral motion of the receptacle member 28.

The receptacle member 28 can include means for tying the infant or doll therein, e.g., filaments 70 (ribbon, string, etc.) that are connected to the receptacle member by, e.g., eyelets hooks, etc.

I claim:

1. A device for carrying an infant or a child's toy doll comprising:

a. a pair of curvilinear C-shaped first portions adapted to rest on the shoulders of a user of said device, and an elongated second portion depending from each C-shaped portion, each said second portion having a first major surface part facing a portion of said first portion and an oppositely disposed second major surface part, each elongated second portion having a plurality of perforations along at least a portion of the length thereof, thereby permitting the adjustment of the location of a supporting element and a receptacle member therealong;

b. a substantially C-shaped rigid supporting element releasably attached to each said second major surface part of said second portion by engaging selected ones of said perforations and projecting therefrom in a direction opposite said first portion;

c. a receptacle member removably attached to said supporting element, said receptacle having a substantially semicylindrical configuration;

d. a pair of rocker elements integral with the outer semicylindrical side of said receptacle said rocker elements being spaced for association with said rigid supporting elements, said rocker elements including a pair of rockers parallel to each other spaced apart the distance equal to a width of a supporting element, said supporting elements each being receivable between a respective pair of rockers.

2. A device as in claim 1, wherein said device further comprises means extending between said depending portions for limiting the motion of said depending portions in opposite directions away from each other.

3. A device as in claim 1, wherein said supporting element comprises an angular projection for receiving said angular projection, thereby retaining said supporting element in position.

4. A device as in claim 1, wherein said receptacle member comprises means for tying said infant or said doll in said receptacle.

* * * * *